United States Patent [19]

Kochnev et al.

[11] Patent Number: 4,909,337

[45] Date of Patent: Mar. 20, 1990

[54] ROTOR OF A SCREW HYDRAULIC DOWNHOLE MOTOR, METHOD FOR ITS PRODUCTION AND A DEVICE FOR ITS PRODUCTION

[76] Inventors: Anatoly M. Kochnev, prospekt Dekabristov,16,kv.46; Andrei N. Vshivkov, ulitsa Pushkina,11,kv.131; Vladimir B. Goldobin, ulitsa Komissara Pozharskogo,11,kv.133; Samuil S. Nikomarov, ulitsa Stakhanovskaya,42,kv.10, all of Perm, U.S.S.R.

[21] Appl. No.: 131,045

[22] PCT Filed: Jan. 31, 1986

[86] PCT No.: PCT/SU86/00008

§ 371 Date: Sep. 1, 1987

§ 102(e) Date: Sep. 1, 1987

[87] PCT Pub. No.: WO87/04753

PCT Pub. Date: Aug. 13, 1987

[51] Int. Cl.[4] ..... E21B 4/02; F03C 2/00; B23P 15/02; B21D 26/02

[52] U.S. Cl. ..... 175/107; 175/323; 29/421.1; 29/888.023; 29/889.72; 72/63; 72/370; 418/48

[58] Field of Search ..... 175/107, 323; 418/48; 166/104; 29/156.4 R, 156.8 R, 421.1; 72/60, 63, 370

[56] References Cited

U.S. PATENT DOCUMENTS

| | | | |
|---|---|---|---|
| 1,378,442 | 5/1921 | Chalfant | 72/370 |
| 2,463,341 | 3/1949 | Wade | 418/48 X |
| 2,464,011 | 3/1949 | Wade | 418/48 |
| 2,532,145 | 11/1950 | Byram | 418/48 |
| 3,512,904 | 5/1970 | Allen | 418/48 |
| 3,822,972 | 7/1974 | Ogly et al. | 418/48 |
| 3,889,506 | 6/1975 | Shaffer | 72/370 |
| 4,127,368 | 11/1978 | Langer | 418/48 |
| 4,397,619 | 8/1983 | Alliquander et al. | 175/107 X |
| 4,567,953 | 2/1986 | Baldenko et al. | 175/107 |
| 4,585,401 | 4/1986 | Baldenko et al. | 418/48 |

FOREIGN PATENT DOCUMENTS

| | | | |
|---|---|---|---|
| 2240423 | 3/1974 | Fed. Rep. of Germany | 418/48 |

*Primary Examiner*—Bruce M. Kisliuk

*Attorney, Agent, or Firm*—Burgess, Ryan & Wayne

[57] ABSTRACT

A rotor (1) of a screw hydraulic downhole motor, made as a hollow multiple-start screw featuring a substantially constant wall thickness. The ratio of the length of the rotor (1) cross-sectional outside contour to the length of the circumscribed circle of the contour is substantially within 0.9 and 1.05. When making the rotor (1) a forming element is inserted into a tubular blank, and a fluid pressure is applied to the outside blank surface. A device for making the rotor comprises a hollow housing accommodating a forming element installed on centering bushings. The bushings have fitting areas adapted for the ends of the tubular blank to fit thereon.

8 Claims, 4 Drawing Sheets

ROTOR OF A SCREW HYDRAULIC DOWNHOLE MOTOR, METHOD FOR ITS PRODUCTION AND A DEVICE FOR ITS PRODUCTION

TECHNICAL FIELD

The present invention relates to drilling equipment and more specifically, to one of the major units of screw hydraulic downhole motors applicable for drilling oil and gas wells, viz., the rotor of a screw hydraulic downhole motor, and to a method for producing said rotor.

PRIOR ART

Known in the art presently is a downhole motor with a multi-lobe rotor made as a solid metallic multiple-thread screw, wherein the number of starts of the helical surface (helical teeth) is in excess of one (cf. USSR Inventor's Certificate No. 926,209, Int. Cl. E 21B 4/02, published on May 7, 1982).

The rotor is accommodated inside a stator featuring an inner multiple-thread helical surface, wherein the number of starts is in excess of that of the rotor by one; said helical surface is moulded on the lining made of a resilient material, such as rubber pasted to the inner surface of the stator frame. The rotor axis is offset with respect to the stator axis which aligns with the motor axis, by an amount of eccentricity equal to half the length of the rotor and stator teeth, while the ratio of the axial pitch of the rotor helical teeth to the axial pitch of the stator helical teeth equals the ratio between the number of teeth on said motor components. When the rotor teeth engage the stator teeth, spaces are formed, opening to the rotor top portion and closing over the length of the helix lead. When drilling mud is injected into the screw hydraulic down hole motor from the earth's surface along the drill string to the bottom end of which the screw hydraulic downhole motor is connected, the rotor of the motor performs planetary motion, while the rotor axis rotates about the stator axis in the counterclockwise direction at an angular velocity $\omega_1$, and the rotor itself rotates about its own axis in a clockwise direction at an angular velocity $\omega_2$. The magnitude of the angular velocity $\omega_1$ is equal to that of the angular velocity $\omega_2$ multiplied by the number of rotor teeth, while the centrifugal force acting on the rotor is proportional to its mass and to the square of the angular velocity $\omega_1$.

However, the large mass of a solid rotor and the high magnitude of the angular velocity $\omega_1$ of rotation of the rotor result in high centrifugal forces arising during the operation of the motor. These forces induce vigorous transverse vibrations which affect adversely the durability of the rotor, stator, hinge joints, as well as of the threaded joints of the motor and the drill string.

The multi-lobe rotor of the aforediscussed motor is manufactured by virtue of gear hobbing, i.e., cutting with a metal-cutting tool called the hob. The method is an expensive one, suffers from an inadequate productivity, fails to provide a high quality rotor teeth surface finish and involves sophisticated and costly metal-cutting machinery and tools. Furthermore, resort should be made to polishing or grinding of the rotor working surfaces to improve the quality of surface finish, which is a complicated technological task on account of the intricate configuration of the rotor and its long overall length.

In addition, it is due to a great length of the multi-lobe rotor that the cutting lips of a hob grow worn in the course of rotor machining, which affects badly the accuracy of the finished product.

Another screw hydraulic downhole motor known in the present state of the art comprises a hollow multi-lobe rotor. For the purpose of joining with a cardan or a flexible shaft, the rotor is rigidly connected, by virtue of a threaded joint, to the union coupling (cf, a textbook "Screw hydraulic downhole motors for well drilling" by M. T. Gusman et al., 1981, Nedra PH, (Moscow), pp. 125–188 (in Russian). The rotor in question is hollow-centered by removal of the metal from the central portion thereof either by virtue of a center hole drilled in the rotor or through the use of a thick-walled pipe shell.

This makes it possible to reduce to some extent the centrifugal forces applied to the rotor, thus ell.

This makes it possible to reduce to some extent the centrifugal forces applied to the rotor, thus lowering the dynamics of transverse oscillations both of the rotor and of the motor as a whole. However, a considerable mass of metal remains in the bulk of the rotor teeth in the peripheral portion thereof, with the result that high centrifugal forces arise during the motor operation, which affect adversely the motor durability.

Moreover, joining the rotor with a cardan or a flexible shaft through a coupling incorporating threaded joints is unreliable, since such joints are likely to disengage under the action of dynamic forces resulting from motor operation.

The helical teeth of the rotor of the motor under consideration are also produced by the gear-hobbing technique which suffers from the disadvantages mentioned above.

Furthermore, provision of a solid rotor or a rotor made from a thick-walled pipe leads to high consumption of stainless steel. Motors incorporating the aforedescribed rotor feature relatively low efficiency and power output, since great mechanical losses occur during operation for the stator rubber to self-heat.

There is known a more productive and efficient method for making the single-lobe rotor of the Moineau screw pump (cf. U.S. Pat. No. 2,464,011 National Patent Classification 103–117, published on Mar. 8, 1949).

The method consists in deforming a tube blank on a formative helical surface by virtue of a fluid pressure applied to said tube blank.

The method is carried into effect through a device comprising a housing which accommodates a forming element with the formative surface, the tube blank being situated inside said forming element.

The formative helical surface is situated on the inner surface of the forming element which serves at the same time as the housing and has a number of axial joints. A fluid pressure is built up in the bore (or hollow space) of the tube blank located inside the forming element provided with seals. The process of forming the rotor of a single-screw pump is carried out in a number of stages, each being followed by extracting the tube blank from the forming element for annealing with a view of reducing the hardness of the blank and relieving internal stresses therein.

The aforediscussed method and the device for carrying it into effect suffer from too low quality of the rotor outer surface on which there are marks left by the joint surface of the forming element, elimination of said marks involving additional machining of the rotor outside surface using special equipment.

Another disadvantage of said method and device resides in a sophisticated process for making the inner surfaces of the split forming element, as well as a complicated procedure of bringing the formative helical surfaces in coincidence in the jointing planes. The disadvantages manifest themselves more conspicuously when making rotors featuring high length-to-diameter ratio, thus rendering impossible the production of multilobe rotors by the method described above.

One more disadvantage inherent in the aforementioned known method is the necessity to apply high hydrostatic fluid pressure, since the pipe blank undergoes considerable tensile deformation. This, in turn, accounts for high specific power consumption of the process.

Essence of the Invention

It is a primary and essential object of the invention to provide a rotor of a screw hydraulic downhole motor for drilling wells, and a method and a device for its production, which would make it possible, due to constructional features of the rotor, to improve output power characteristics of the motor, reduce friction loss and increase rotor production efficiency.

The essence of the invention resides in that the rotor of a screw hydraulic downhole motor made as a multiple-thread screw having the number of teeth on the helical surface exceeding one and rigidly connected to a union coupling, according to the invention, is substantially hollow and features substantially constant wall thickness, while the ratio of the length of the rotor cross-sectional outside contour to the length of a circle circumscribed around said contour is substantially within 0.9 and 1.05.

Such a constructional arrangement of the rotor makes it possible to improve the output power characteristics of the motor, reduce transverse vibrations, add to the strength of the rotor with respect to the torque applied thereto and bending load imposed thereon, decrease the rotor mass and its specific metal content, cut down stainless steel consumption, and better the quality of its manufacture.

The essence of a method for the rotor production resides in that a tubular blank is subjected to deformation on the formative surface by virtue of a fluid pressure and in that, according to the invention, the forming element whose outside surface is in fact the formative surface, is placed inside the tubular blank, while the fluid pressure is applied to the outside surface of the tubular blank.

This enables one to attain high quality of the rotor helical surface, reduce power and labour consumption for its manufacture, cut down production time and thus obtain a rotor featuring improved technical characteristics, higher quality of surface finish and precision, which makes it possible to minimize friction loss and improve output power characteristics of a motor incorporating the rotor of the present invention.

On some occasions it is expedient that the forming process of a tubular blank be carried out in two stages, at the first of which the tubular blank is given the shape of a helical polyhedron with rounded-off verticles, featuring the diameter of a circumscribed circle drawn there around somewhat in excess of the diameter of a circumscribed circle drawn around a finished rotor, and the number of faces is equal to the number of threads (or starts) of the rotor helical surface, whereas at the second stage the rotor helical surface is formed finally.

This enables one to avoid metal wrinkling during the forming process of a tubular blank and ensure excellent workmanship, high dimensional accuracy and trueness of geometrical shape.

It is expedient that before exerting pressure on the tubular blank a union coupling recessed on its outside surface be inserted into said blank, and the latter be forced against the surface of the union coupling concurrently with the formation of the rotor helical surface, thus making the blank fast in the rotor.

This makes it possible to cut down the time spent for production of a rotor with a union coupling due to simultaneous (combined) forming of the rotor helical working surface and securing of the union coupling in the rotor. Besides, there are provided higher reliability and pressure-tightness of the joint of the rotor with said coupling.

The essence of a device for making said rotor by the method set forth hereinbefore consists in that it comprises a housing which accommodates a forming element having a formative surface, wherein, according to the invention, the forming element is installed inside the housing on centering bushings, while the formative surface is provided on the forming element outside surface, and the centering bushes have fitting areas adapted for the tubular blank ends to fit tightly thereon.

This provides for reliable location of the for ming element with respect to the housing and tubular blank and production of a rotor having high-quality outside working surface, as well as simplifies the manufacture of the forming element.

It is expedient that each centering bushing be provided with a projection adjacent to its fitting area and adapted for the tubular blank set on said fitting area, to rest against, and that said projection have an annular groove whose width is substantially equal to the thickness of the tubular blank, said groove being adapted for a seal to accommodate.

This provides for reliable original hermetic sealing of the high-pressure chamber of the device before beginning the process of deformation of a tubular blank on the fitting areas of the centering bushings, as well as makes it possible to attain more reliable operation of the rotor manufacturing device.

It becomes necessary, on some occasions, that the forming element should be replaceable in the housing and that a preforming element be provided for preliminary formation, made as a helical polyhedron with rounded-off vertices, featuring the diameter of its circumscribed circle somewhat in excess of the diameter of a circumscribed circle of the forming element for finishing formation, the number of the faces of said polyhedron being equal to the number of threads on the rotor helical surface.

This makes it possible to prevent wrinkling on the rotor working surfaces and provide high quality of said surfaces, high dimensional accuracy and trueness of geometric shape.

SUMMARY OF THE DRAWINGS

In what follows the invention is illustrated by a detailed description of a specific embodiment thereof with reference to the accompanying drawings, wherein.

PREFERRED EMBODIMENT OF THE INVENTION

Figure 2:
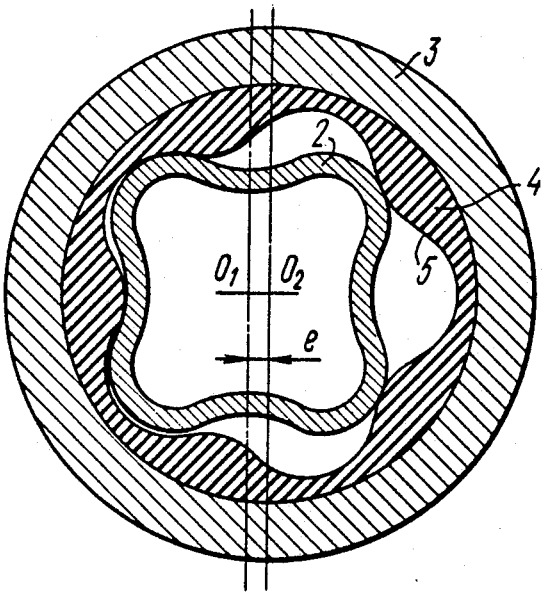
FIG. 2 is a cross-sectional view of the motor, taken along the line II—II.

A rotor 1 is in effect one of the major components of a downhole motor (FIG. 1); it is made as a multiple-thread screw having external helical teeth 2, the number of threads (teeth) on the helical surface being in excess of one. The rotor 1 is accommodated inside a stator 3 which is provided with a lining 4 made of such a resilient material as rubber. The lining 4 has an inside helical surface which forms helical teeth 5 the number of which exceeds the number of teeth on the rotor 1 by one. An axis $O_1$ (FIG. 2) of the rotor 1 is offset with respect to an axis $O_2$ of the stator 3 by an amount "e" of eccentricity. The rotor 1 (FIG. 1) is associated with a shaft 6 of a bearing unit 7 of the motor through a flexible shaft 6 or a cardan shaft (not shown). The bearing unit 7 comprises axial and radial bearings (not shown) adapted to take up bottom-hole loads. Connected to the lower end of the shaft 6 of the bearing unit 7 is a rock destruction tool 9. The stator 3 of the motor is connected, through an adaptor, to the lower end of a drill string.

Figure 1:
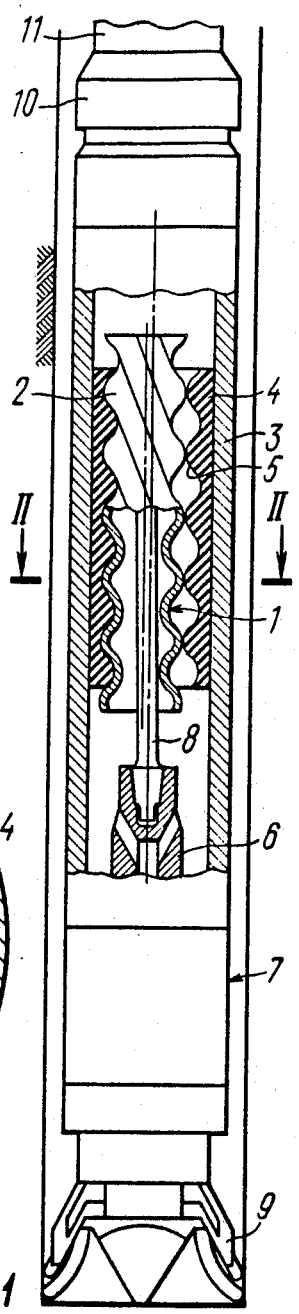
FIG. 1 is a schematic, partly longitudinal sectional view of a screw hydraulic downhole motor for drilling oil and gas wells, incorporating the rotor, according to the invention.

The rotor 1 (FIGS. 3, 4), according to the invention, is a hollow structure, comprising a tubular shell 12 (housing) and a union coupling 13 (FIG. 3) rigidly held to said shell and adapted for association with the flexible shaft 8 (FIG. 1). The union coupling 13 (FIG. 3) is provided with elements 14 for connecting the flexible shaft 8, e.g., threads, through some alternatives may be resorted to, such as welding joining by means of cones, etc.

It is a preferable method of holding the union coupling 13 to the tubular shell 12 by forcing the latter against the shaped outside surface of the union coupling 13, wherein recesses 15 are provided by the method described below. The recesses 15 may be shaped as radial blind holes, longitudinal or cross slots or flats, annular or helical grooves, or any combinations thereof. It is important that projections 16 that are established on the inner surface of the tubular shell 12 as a result of forcing the terminal portion of the tubular shell 12 against the shaped outside surface of the union coupling 13, should interact with the recesses 15 of the union coupling 13 so as to transmit the torque and axial load.

Figures 3, 4, 5:
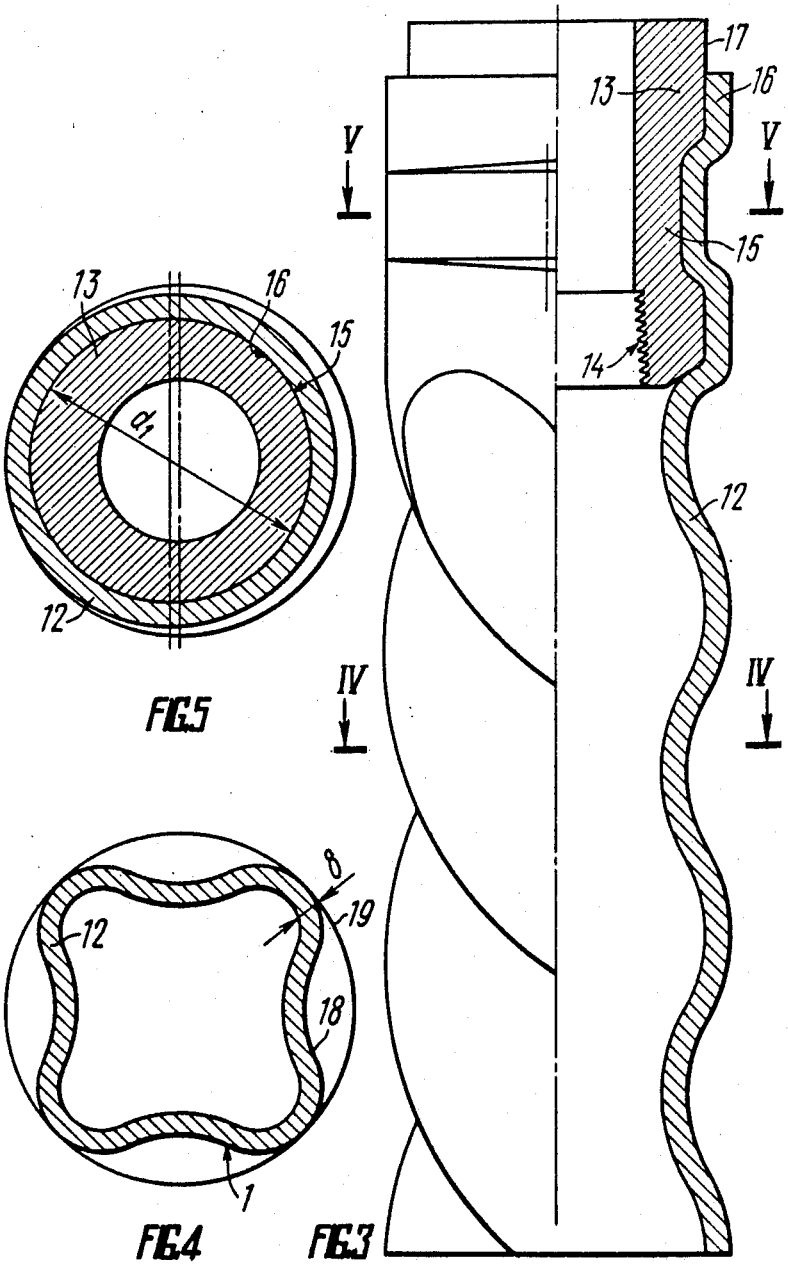
FIG. 3 is a longitudinal-section view of the rotor, according to the invention.
FIG. 4 is a cross-sectional view of the rotor, taken along the line IV–IV.
FIG. 5 is a cross-sectional view of the rotor, taken along the line V—V.

Shown as an example of FIGS. 3 and 5 is the recess 15 shaped as an annular groove having a diameter $d_1$ and being eccentric with respect to an outside cylindrical surface 17 of the union coupling 13.

The ratio of the length of an outside contour 18 of the cross-section of the rotor 1 to the length of a circle 19 circumscribed around said contour, is substantially within 0.9 and 1.05. When said ratio is below 0.9, other things being equal, this results in adversely affected output power characteristics of the screw motor as to the torque developed and the output power (due to a reduced number of rotor threads), in reduced torsional and bending strength of the hollow rotor, as well as in deteriorated quality of rotor manufacture by the method and device proposed herein and described in detail below, due to wrinkling on the rotor surface and departure from a true geometric shape of the rotor.

When said ratio exceeds 1.05 this results in reduced efficiency of the motor (due to an increased number of the rotor threads), in affected torsional and bending strength of the rotor, and in some difficulties encountered in the manufacture of the rotor according to the method and device proposed in this invention and described in detail hereinbelow, due to considerably increased values of working pressure as well as on account of high power consumption of the rotor production process.

The rotor disclosed in this invention operates as follows. When drilling mud is fed from the earth's surface along the drill string 11 (FIG. 1), the rotor 1 is urged to rotate, under the action of an unbalanced fluid pressure applied to its lateral helical surface, thus rolling over the teeth of the stator 3. The torque and axial (thrust) load developed on the rotor as a result, are transmitted to the shaft 6 of the bearing unit 7 through the flexible shaft 8 connected to the rotor 1 through the union coupling 13. Further on rotation from the shaft 6 of the bearing unit 7 is translated to the rock destruction tool 9.

The rotor of a screw hydraulic downhole motor described above is manufactured as follows. A forming element having an outer formative surface shaped as a multiple-thread helical surface, is placed in a tubular blank that has preliminarily been machined on its outside surface to a required quality of surface finish (e.g., by grinding, polishing, etc.). Thereupon the ends of the tubular blank are hermetically sealed with respect to the forming element, at the same time mutually centre-aligning the tubular blank and the forming element, and a pressure of such a fluid as, e.g., mineral oil is applied to the outside surface of the tubular blank. Under the effect of said fluid pressure the tubular blank loses stability and gets deformed cross-sectionally, with the result that the blank becomes snug against the formative surface of the forming element, thus acquiring the required geometric shape of a multi-lobe rotor of a screw hydraulic downhole motor. In some cases, particularly with a great length of the rotor teeth and their low number, the process of forming the rotor teeth by the aforedescribed method is expedient to carry out in two stages. At the first stage the tubular blank is subjected to partial deformation for an incomplete tooth length, thus imparting to it the shape of a helical polyhedron with rounded-off vertices, while at the second stage the rotor helical surface is finish-formed. In this case a quality helical surface free from wrinkles and other departures from true geometric shape is obtained at the first stage due to a reduced amount of radial deformation. The first stage of the process may be conducted at a reduced fluid pressure, since that stage is aimed at overcoming the stability of the tubular blank cylindrical shape and performing a helical surface having the same number of threads and the same helix lead as in the finished rotor. The tubular blank obtained at the first stage as a helical polyhedron is subjected to final forming to establish the helical surface of the rotor, by the same method, i.e., by applying a fluid pressure to the outside surface of the tubular blank inside which the forming element is placed.

On many occasions an optimum method for making the rotor is the one, wherein the process for forming a helical surface on the rotor proceeds simultaneously with the joining of its tubular shell 12 with the union coupling 13. To this end there is inserted in the interior of the tubular blank before its forcing by the fluid pressure, the union coupling 13 whose outside surface is made profiled or shaped, that is, is provided with recesses having this or that form, e.g. radial blind holes, longitudinal cross slots or flats, annular or helical grooves, or any combinations thereof. When forcing the terminal portion of the rotor tubular shell, projections are formed on the shell inner surface, which are adapted to interact with the recesses in the union coupling, thus making it possible to impart the torque and axial forces developed on the rotor tubular shell, to the union coupling and further on to the flexible shaft.

Figures 6, 7:
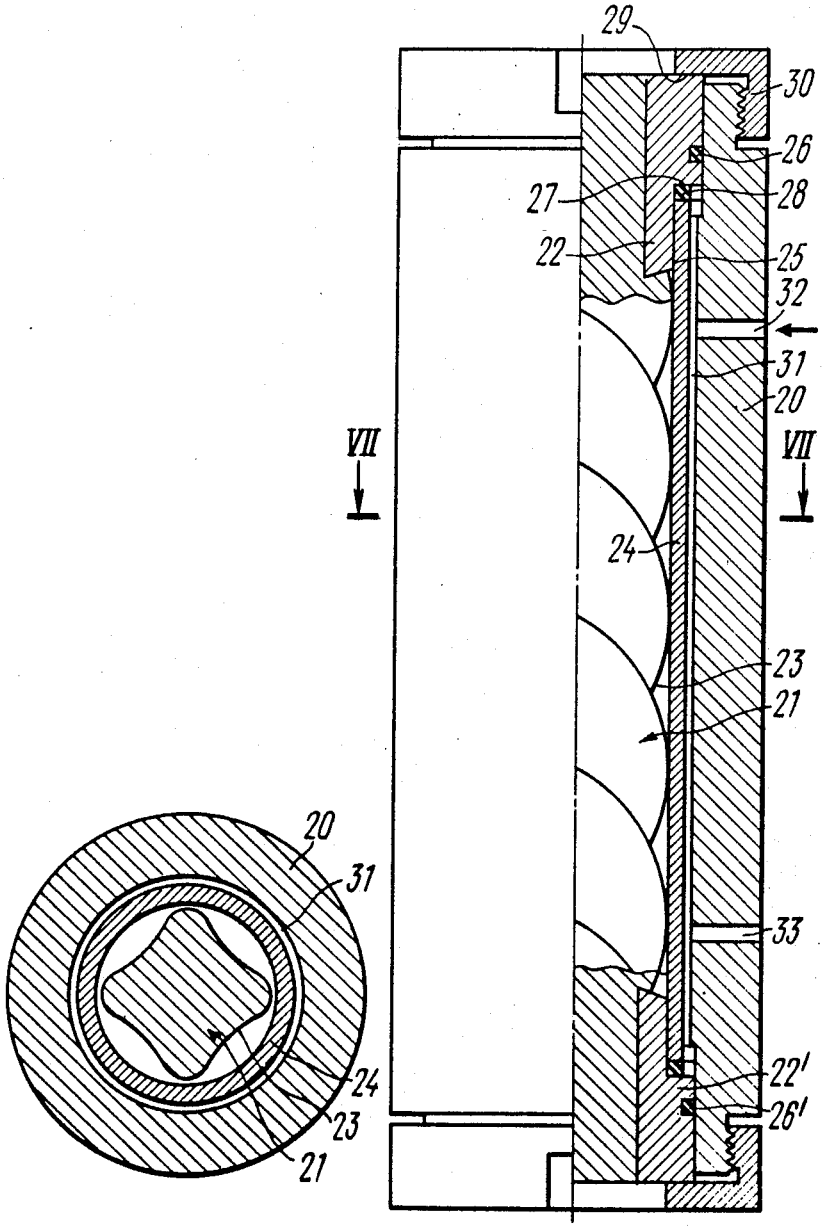
FIG. 6 is a longitudinal-sectional view of a device for making the rotor, according to the invention.
FIG. 7 is a cross-sectional view of a device for making the rotor, taken along the line VII—VII.

The aforedescribed method for producing a rotor of a screw hydraulic downhole motor can be carried into effect with the aid of a device shown in FIG. 6 in a longitudinal section, and in FIG. 7, in a cross-section. The device comprises a thick-walled tubular housing 20 which accommodates a forming element 21 center-aligned with the housing 20 by means of centering bushings 22, 22' (FIG. 6). The outside formative surface of the forming element 21 is shaped as helical teeth 23 having the same hand of helix and helix lead as the rotor being manufactured, whereas the cross-sectional dimension of the forming element 21 is equidistant with respect to the rotor cross-sectional outside contour. The amount of equidistance equals the thickness $\delta$ (FIG. 4) of the wall of a tubular blank 24. Fitting areas 25 are provided on the outside surface of the centering bushings 22 (FIG. 6), on which the end portions of the tubular blank 24 are fitted.

The centering bushings 22, 22' are provided with seals 26, 26' located at the places of contact of said bushings with the housing 20. The aforesaid seals are in the form of, e.g., rubber O-rings.

The centering bushing 22 has a projection adjacent to the fitting area 25 and has an end annular groove 27, which receives a seal 28 made of rubber or any other elastic material. The width of the groove is substantially equal to the thickness $\delta$ of the tubular blank 24. The tubular blank 24 is located on the fitting areas 25 (only one of these being shown in the FIGURE) of the centering bushings 22, 22' in such a manner that the ends of the blank 24 rest against the faces of the seals with some axial tension applied to the rubber. Axial holding of the tubular blank 24, the centering bushings 22, 22' with the seals 28 (only one of these being shown in FIGURE), and the forming element 21 is by means of the inside faces 29 of circular nuts 30 (only one of these being shown) turned onto the end threads of the housing 20.

A chamber 31 is established between the outside surface of the tubular blank 24 and the inside surface of the housing 20 for a fluid under pressure to feed. Ports 32 and 33 are provided in the housing 20 for the purpose.

Figure 8:
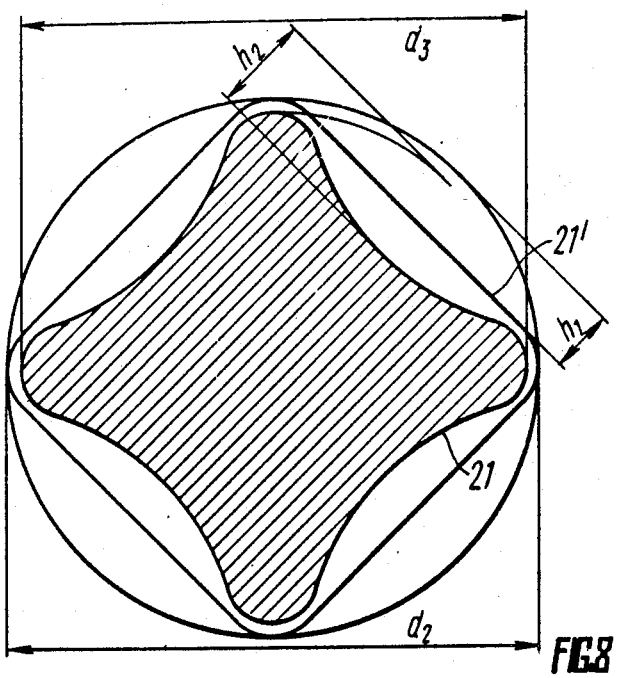
FIG. 8 is a cross-sectional view of the forming cores for preliminary and finishing forming process.

According to the herein-proposed method, when the rotor is manufactured in two stages, the forming element 21 (FIG. 8) is made replaceable. A forming element 21' for preliminary forming is made as a helical polyhedron having the cross-sectional shape of a polygon, with rounded-off vertices and features a reduced length $h_1$ of helical teeth and an increased outside diameter $d_2$ as compared with respective dimensions $h_3$ and $d_3$ of the forming element 21 for finish-forming FIG. 8 represents the superposed cross-sectional contours of the forming elements 21' and 21 for preliminary and finish forming, respectively.

The device is assembled and operates as follows. The forming element 21 is inserted in the tubular blank 24 that has preliminarily been machined on its outside surface to a quality of surface finish required for the rotor (e.g., by grinding, polishing, etc.). The centering bushing 22' is set on one end of the forming element 21, simultaneously engaging the end portion of the tubular blank 24 with the fitting area of the centering bushing 22'. Then the forming element 21 with the tubular blank 24 and one of the centering bushings 22, 22' is placed in the housing 20. Next the other centering bushing 22 is set on the free end of the forming element 21, simultaneously bringing its fitting area into the tubular blank 24, and the outside surface of the centering bushings 22, into the housing 20. Thereupon the thus-assembled components are held in place in the housing 20 by means of nuts 30 until the ends of the tubular blank 24 are somewhat forced into the bulk of the rubber seals 28. Then a fluid, e.g., a mineral oil is fed to the chamber 31 of the device through the port 32 of the housing 20 to expel air from the chamber 31 through the port 33. As soon as oil appears from the port 33, the latter is shut with a cock (omitted in the Drawing). As the feed of the fluid continues the cylindrical tubular blank is liable to lose its stability under the effect of externally applied pressure, thus becoming forced against the formative helical surfaces of the forming element 21, whereby the rotor helical teeth are formed on the outside surface of the tubular blank 24. The seals 26 establish pressure-tightness in the joint clearances between the housing 20 and the centering bushings 22 (and equally the bushing 22'), while the clearances between the centering bushings 22, 22' and the tubular blank 24 are pressure-tightened at the initial instant due to the fact that the ends of the tubular blank 24 are somewhat forced into the rubber seals 28. As the fluid pressure in the chamber 31 rises and deformation of the tubular blank 24 progresses, the clearances between the tubular blank 24 and the fitting areas 25 of the centering bushings 22, 22' are pressure-tightened by virtue of hydraulic forcing of the tubular blank 24 against said fitting areas.

On completion of the deformation process applied to the tubular blank 24, which is judged by a rapid fluid pressure rise, the pressure is relieved, the device is disassembled and the forming element 21 is removed from the tubular shell of the rotor.

Figure 9:
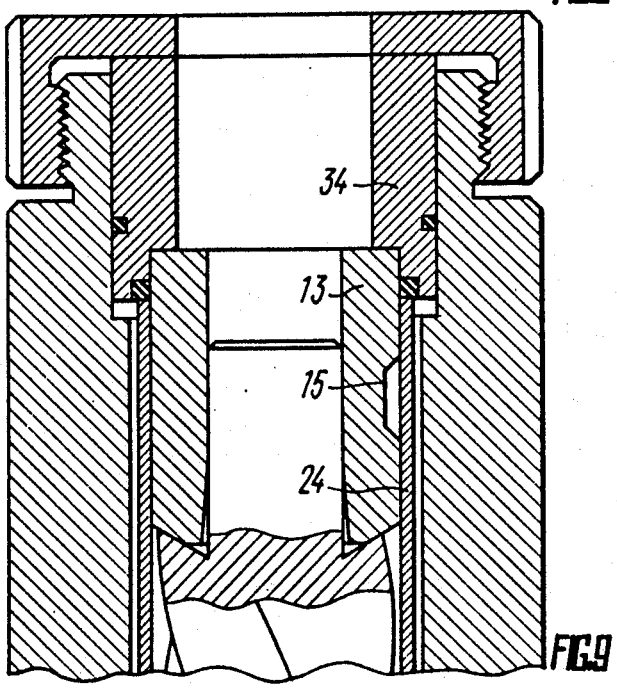
FIG. 9 is a fragmentary longitudinal-sectional view of a device for making the rotor with simultaneous forcing of a union coupling.

FIG. 9 illustrates an embodiment of the method for making the rotor of a screw hydraulic downhole motor with a simultaneous pressing-in of the union coupling 13. According to said embodiment, one end of the forming element 21 is located in the housing 20 by means of a centering bushing 34 which accommodates the union coupling 13 whose outside surface serves as the fitting areas for the tubular blank 24 and is provided with the recess 15 shaped as an eccentric groove. The process of forming the rotor helical surface proceeds concurrently with the forcing of the union coupling, with the result that a projection is formed on the tubular shell inner surface. The projection engages the recess 15 of the union coupling 13 and is adapted to interact therewith when transmitting the torque and axial load. It is due to the forcing of the tubular blank 24 against the outside surface of the union coupling 13 under the effect of high fluid pressure that hermetic sealing of the joint is attained.

Industrial Applicability

The aforedescribed invention is efficiently applicable for the provision of high-torque screw hydraulic downhole motors for drilling oil and gas wells, such motors featuring improved output power and performance characteristics.

What is claimed is:

1. A rotor (1) of a screw hydraulic downhole motor, made as a multiple-thread screw with the number of helical surfaces exceeding one and rigidly connected to a union coupling (13), characterized in that the rotor (1) is a hollow structure which features substantially constant wall thickness, while the ratio of the length of the rotor cross-sectional contour (18) to the length of a circle (19) circumscribed around the contour is substantially between 0.9 and 1.05.

2. A rotor according to claim 1, characterized in that the rotor includes projections (16) and the coupling (13) is provided with recesses (15) on an outer surface thereof for engaging with the projections of the rotor.

3. A method for producing a rotor for a screw downhole motor, comprising the steps of:

arranging a tubular blank within a housing;

placing, inside said tubular blank, a unitary forming member which is a solid member in the form of a screw having more than one helical surface thread and a cross-sectional profile equidistant with respect to a desired profile of said rotor;

centering and sealing said tubular blank relative to the housing and the forming member;

supplying a working fluid to produce a pressure between said tubular blank and said housing, under which the tubular blank is subjected to three-dimensional deformation along helical surfaces of the forming member so that the length of a circle of a neutral cross-section of the rotor changes, and the ratio of the length of the cross-section of the rotor to the length of a circumscribed circle thereof lies within 0.9 to 1.05;

relieving the pressures and removing the formed rotor together with the forming member from the housing; and removing the forming member from the formed rotor of the screw downhole motor.

4. A method of forming a hollow rotor of substantially constant wall thickness as a multiple-thread screw with the number of helical surfaces exceeding one, for use with a screw hydraulic downhole motor, said method comprising the steps of:

imparting a shape of a helical polyhedron with rounded-off vertices, to a tubular blank, in a first stage, such that the diameter of a circle circumscribed therearound exceeds the diameter of a circle circumscribed around said hollow rotor, and such that the number of faces of said helical polyhedron is equal to the number of threads of the helical surfaces of said rotor, said step of imparting including the steps of:

placing a unitary preliminary forming element having an outside surface serving as a formative surface, inside a tubular blank; and applying fluid pressure to the outside surface of the tubular blank to force the tubular blank against the formative surface; and forming said helical surfaces on said helical polyhedron blank to form said rotor, in a second stage, said step of forming said helical surfaces including:

placing a unitary final forming element having an outside surface serving as a formative surface, inside a tubular blank, and applying fluid pressure to the outside surface of the tubular blank to force the tubular blank against the formative surface of the final forming element, so as to form the rotor with the ratio of the length of the rotor cross-sectioned contour to the length of a circle circumscribed around the contour being substantially between 0.9 and 1.05.

5. A method of forming a hollow rotor of substantially constant wall thickness as a multiple-thread screw with the number of helical surfaces exceeding one, for use with a screw hydraulic downhole motor, said method comprising the steps of:

imparting a shape of a helical polyhedron with rounded-off vertices, to a tubular blank, in a first stage, such that the diameter of a circle circumscribed therearound exceeds the diameter of a circle circumscribed around said hollow rotor, and such that the number of faces of said helical polyhedron is equal to the number of threads of the helical surfaces of said rotor, said step of imparting including the steps of:

placing a unitary preliminary forming element having an outside surface serving as a formative surface, inside a tubular blank; and applying fluid pressure to the outside surface of the tubular blank to force the tubular blank against the formative surface;

forming said helical surfaces on said helical polyhedron blank to form said rotor, in a second stage, said step of forming said helical surfaces including:

placing a unitary final forming element having an outside surface serving as a formative surface, inside a tubular blank; and applying fluid pressure to the outside surface of the tubular blank to force the tubular blank against the formative surface of the final forming element, so as to form the rotor with the ratio of the length of the rotor cross-sectioned contour to the length of a circle circumscribed around the contour being substantially between 0.9 and 1.05.

securing at least one end of said blank to a union coupling simultaneously with said step of forming said helical surfaces, said step of securing including the steps of:

inserting a union coupling having a shaped outside surface into a tubular blank; and subsequently exerting pressure on the tubular blank to force said tubular blank against the shaped outside surface of the union coupling.

6. A device for making a hollow rotor of substantially constant wall thickness as a multiple-thread screw with the number of helical surfaces exceeding one, so as to form the rotor with the ratio of the length of the rotor cross-sectioned contour to the length of a circle circumscribed around the contour being substantially between 0.9 and 1.05, for use with a screw hydraulic downhole motor, said device comprising:

a housing;

a unitary forming element having an outside surface which defines a formative surface for said rotor, said forming element removably accommodated in said housing;

a plurality of centering bushings for installing the forming element in the housing, said centering bushings including fitting areas for tightly receiving a tubular blank used for forming said rotor so that the bushings are positioned between the housing and the forming member;

a plurality of sealing means for sealing said housing;

a chamber defined by; said forming element and said sealing means defining a chamber for pressure-feeding of fluid therein.

7. A device as claimed in claim 6, wherein each said centering bushing includes a projection adjacent the respective fitting area thereof against which the tubular blank rests, said projection having an annular groove for accommodating said sealing means, said annular groove having a width substantially equal to the thickness of said tubular blank.

8. A device for making a hollow rotor of substantially constant wall thickness as a multiple-thread screw with the number of helical surfaces exceeding one, so as to form the rotor with the ratio of the length of the rotor cross-sectioned contour to the length of a circle circumscribed around the contour being substantially between 0.9 and 1.05, for use with a screw hydraulic downhole motor, said device comprising:

a housing;

a unitary preliminary forming element having an outside surface which defines a formative surface for said rotor, said preliminary forming element being removably accommodated in said housing and said preliminary forming element being a helical polyhedron with rounded-off vertices, with the number of faces of the polyhedron being equal to the number of threads on the helical surfaces of the rotor;

a plurality of centering bushings for installing the forming element in the housing, said centering bushings including fitting areas for tightly receiving a tubular blank used for forming said rotor;

a plurality of sealing means for sealing said housing;

a chamber defined by said housing, said forming element, said bushings and said sealing means for pressure-feeding of fluid therein; and a unitary finishing forming element for finishing formation of the rotor after removal of the preliminary forming element, the finishing forming element being removably accommodated in the housing after removal of the preliminary forming element and the diameter of a circle circumscribed around the finishing forming element being less than the diameter of a circle circumscribed around said preliminary forming element.

* * * * *